US005394837A

United States Patent [19]

Tsai et al.

[11] Patent Number: 5,394,837

[45] Date of Patent: Mar. 7, 1995

[54] HIGH-EFFICIENCY FURNACE

[76] Inventors: Frank W. Tsai, 1842 Alpine Dr., San Marino, Calif. 91108; Paul A. Bock, 1576 Clark St., Upland, Calif. 91784

[21] Appl. No.: 202,232

[22] Filed: Feb. 25, 1994

[51] Int. Cl.[6] ..... F22B 15/00

[52] U.S. Cl. ..... 122/235.23; 122/510

[58] Field of Search ..... 122/235, 235.23, 510

[56] References Cited

U.S. PATENT DOCUMENTS 3,172,739 3/1965 Koniewiez .
3,182,638 5/1965 Lee et al. .
3,353,920 11/1967 Kitzen .
3,385,271 5/1968 Fleischer ..... 122/510
3,566,845 3/1971 Barnes .
3,885,530 5/1975 Kivlen et al. .
4,002,149 1/1977 Yamamoto et al. .
4,413,591 11/1983 McCorcle ..... 122/235.23 X
5,005,530 4/1991 Tsai .

*Primary Examiner*—Edward G. Favors
*Attorney, Agent, or Firm*—William W. Haefliger

[57] ABSTRACT

A furnace comprising a lower radiant section and an upper convection section, the lower section having associated fuel burners; generally vertically extending first tubular structure suspended in the first section; second tubular structure extending generally horizontally relative to the first section and suspending the first tubular structure; and grid structure extending generally horizontally and supporting the second tubular structure; whereby hot combustion gases produced by the burners flow upwardly in the first section and past the first and second tubular structure and the grid structure to the upper convection section; and the second tubular structures and/or the grid structure are cooled by circulation of fluids therein.

19 Claims, 7 Drawing Sheets

LEVEL – BELOW HANGER AND RACK TUBES

LEVEL – TOP RETURN BENDS

LEVEL – FLOOR

HIGH-EFFICIENCY FURNACE

BACKGROUND OF THE INVENTION

This invention relates generally to furnaces, and more particularly to furnaces containing heat transfer tubing in "radiant" lower furnace sections and in "convective" upper furnace sections.

Furnaces, as used in the petroleum and petrochemical industries, usually consist of a radiant section and a convection section. For simplicity in construction and low cost, the convection section is built above the radiant section. The radiant coil, which is used for heating and/or reaction of feed, is typically located in the center of the radiant section. The radiant coil consists of a number of horizontal tubes connected by 180° return bends. In order to keep the horizontal tubes from sagging, tube supports are used at three to four feet intervals.

As furnace capacity increases, higher feed rates and firing are used. Higher firing increases the radiant section temperature, which is detrimental to the tube supports. The lives of tube supports are thereby reduced, and they must be replaced often (every three to seven years). As tube supports deteriorate and collapse, damage to the radiant coil-results. Hence, the radiant coil has to be replaced prematurely. Therefore, the maximum allowable temperature of tube supports becomes a constraint of the capacity.

SUMMARY OF THE INVENTION

It is a major object of the invention to provide a method of support for the radiant coil (i.e., tube or tubes) that will materially extend the life or lives of the tube supports, and that will not result in sagging of horizontal tubes in the radiant section.

Basically, the invention involves suspending the radiant section tube or tubes to hang generally vertically, the suspension comprising tubular means, as for example elongated, fluid flow-passing tubes, which extend generally horizontally, and supporting those feed-passing tubes by means of grid structure proximate the uppermost extent of the radiant section. As will be seen, the grid structure itself may comprise flow-passing tubing, i.e., tubing that passes the feed, to pre-heat same or other fluids. Also, the grid structure tubing may extend with serpentine configuration, to provide multiple support points for the elongated tubing that suspends the vertically extending radiant tubing or tubes.

Use of flow-passing tubing as supports allows for reduction in temperature of those supports by heat transfer to the flow, yielding extended support tubing life. In this regard, the combination of the invention basically comprises:

a) a lower radiant section and an upper convection section, the lower section having associated fuel burners, b) generally vertically extending first tubular means in the first section, c) second tubular means extending generally horizontally relative to the first section and suspending the first tubular means, d) and grid structure extending generally horizontally and supporting the second tubular means, e) whereby hot combustion gases produced by the burners flow upwardly in the first section and past the first and second tubular means and the grid structure to the upper convection section.

Another object is to provide for flow-passing communication between the first and second tubular means, or first and third tubular means, or first, second, and third tubular means.

Yet another object is to support the serpentine grid structure (i.e., third tubular means) on non-degradeable ledges associated with furnace side walls.

An additional object is to suspend the vertical tubing from the horizontal second tubular means, via metallic hangers, which are easily replaced as may be needed, or to simply pass the second or third tubular means below the top return bends of the radiant coil. In another form of the invention, no hangers are required, insuring further the life of the system.

These and other objects and advantages of the invention, as well as the details of an illustrative embodiment, will be more fully understood from the following specification and drawings, in which:

DRAWING DESCRIPTION

Figure 4:
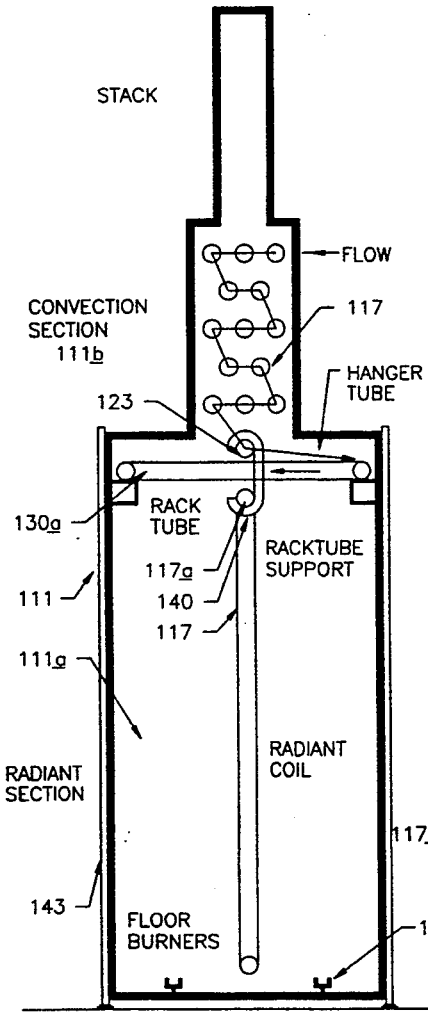
FIGS. 4 and 5 are front and side elevations showing a modification.
Figure 5:
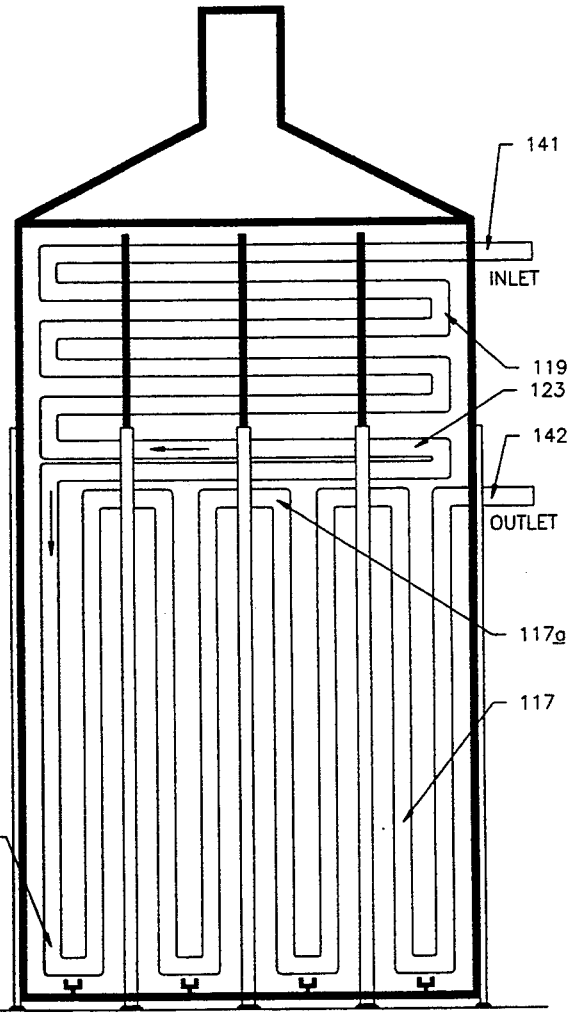
Figure 6A:
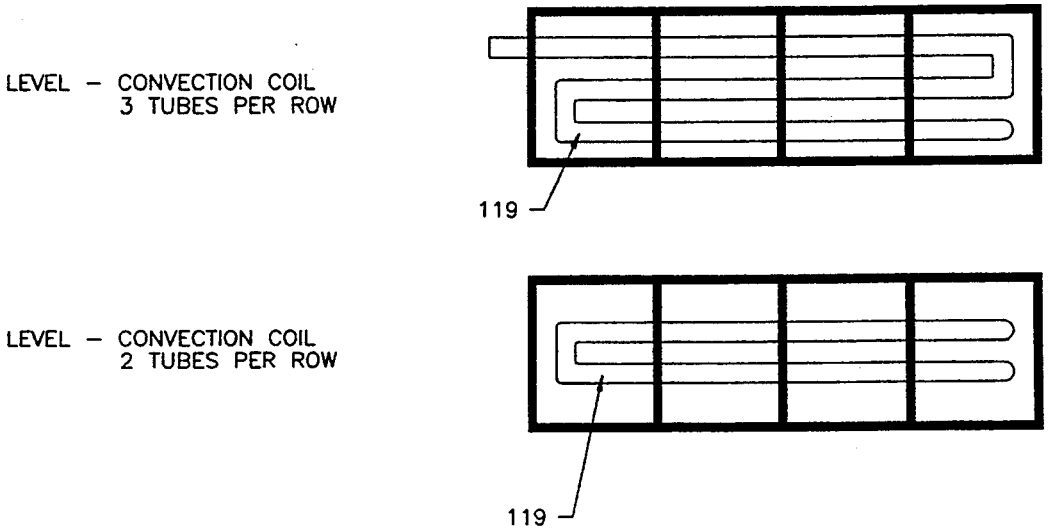
Figure 6B:
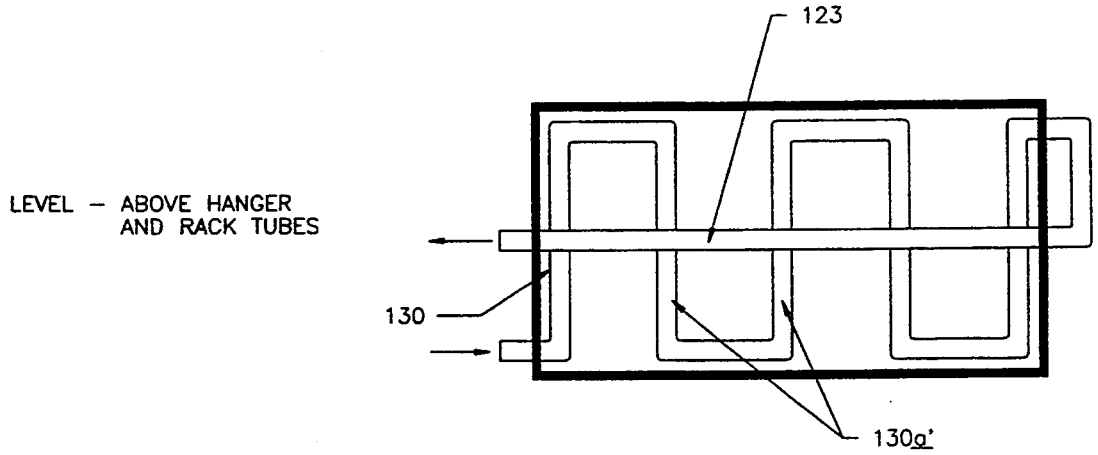
Figure 6C:
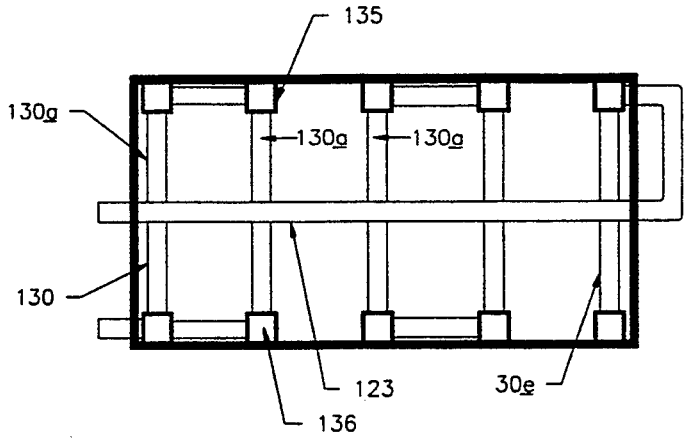
Figure 6D:
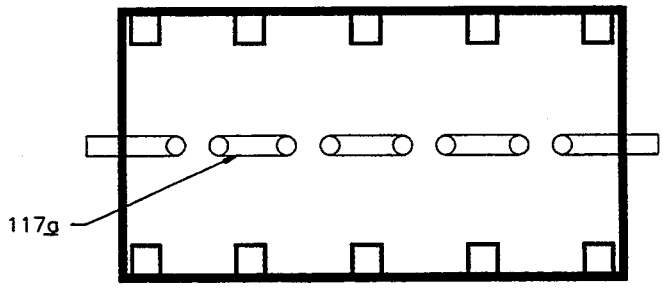
Figure 6E:
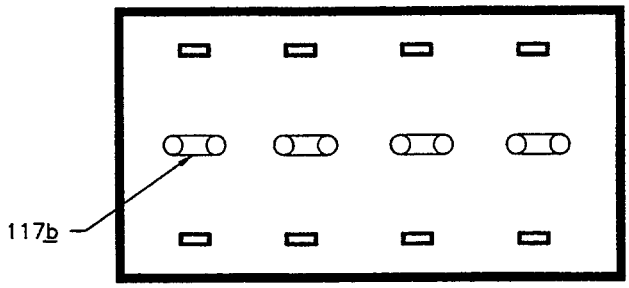
Figure 7A:
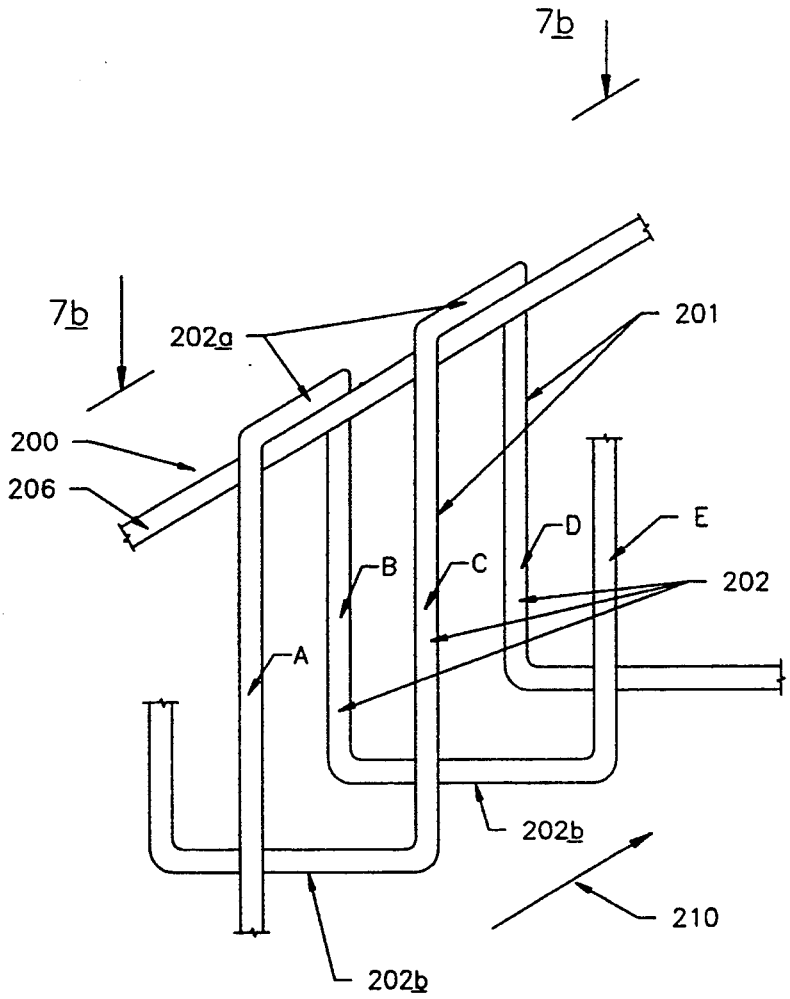

FIGS. 6*a*–6*e* are plan views taken at different levels in FIGS. 4 and 5;

FIG. 7*a* is a perspective view of another embodiment; and

Figure 7B:
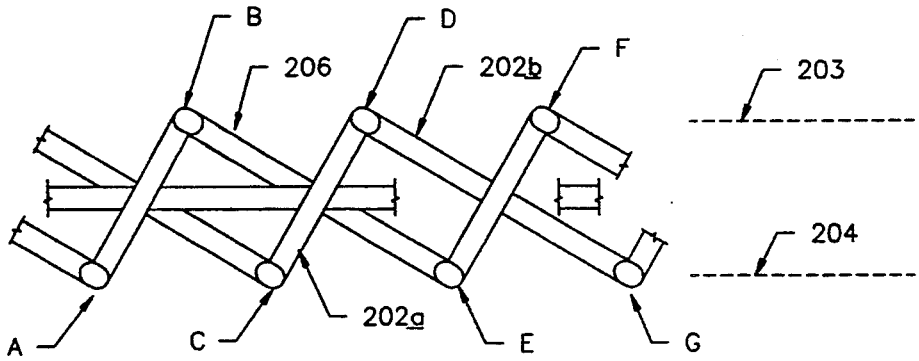

FIG. 7*b* is a plan view taken on lines 7*b*–7*b* of FIG. 7*a*.

DETAILED DESCRIPTION

Figure 2:
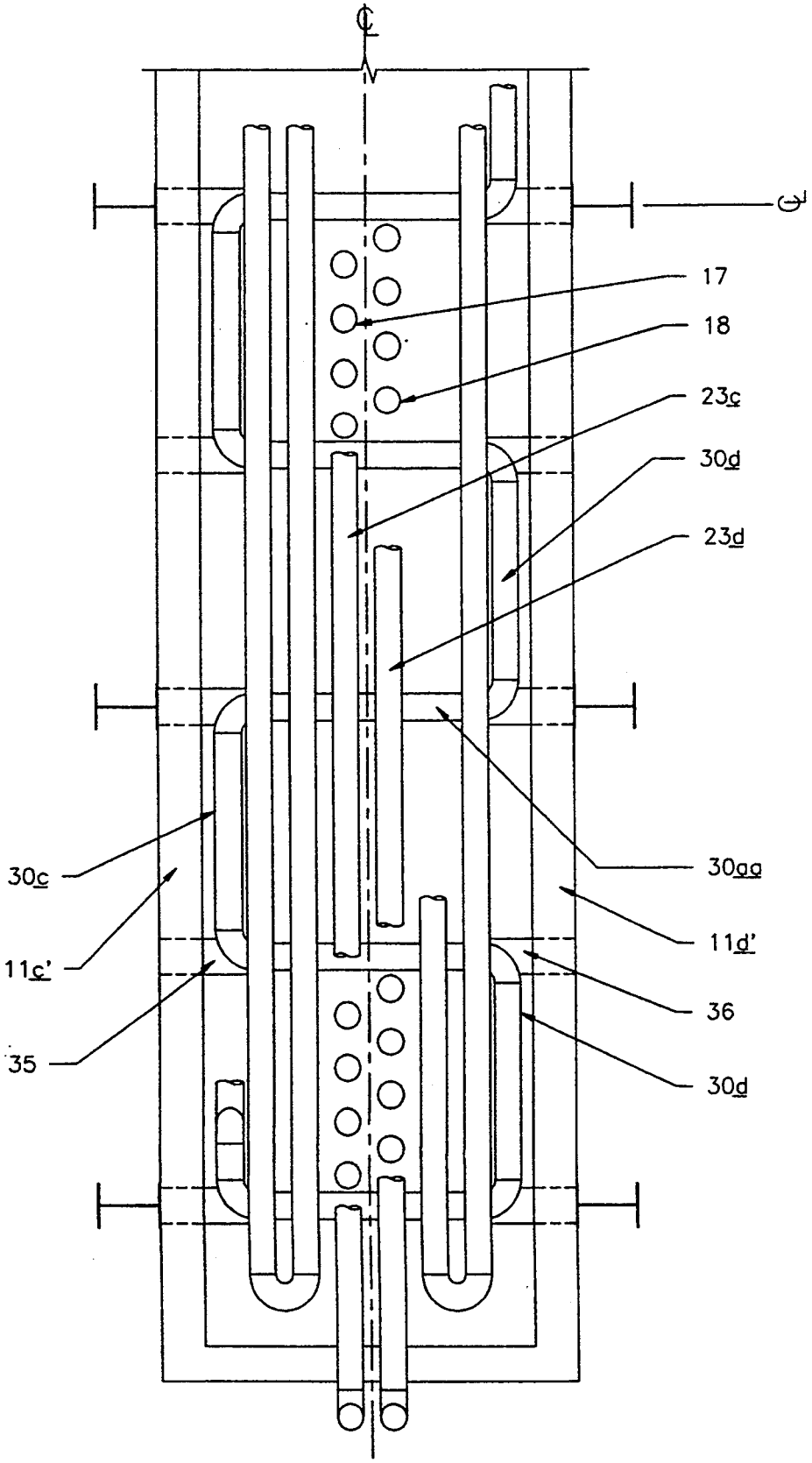
FIG. 2 is an end elevation showing six support tubes, and a support grid.
Figure 3:
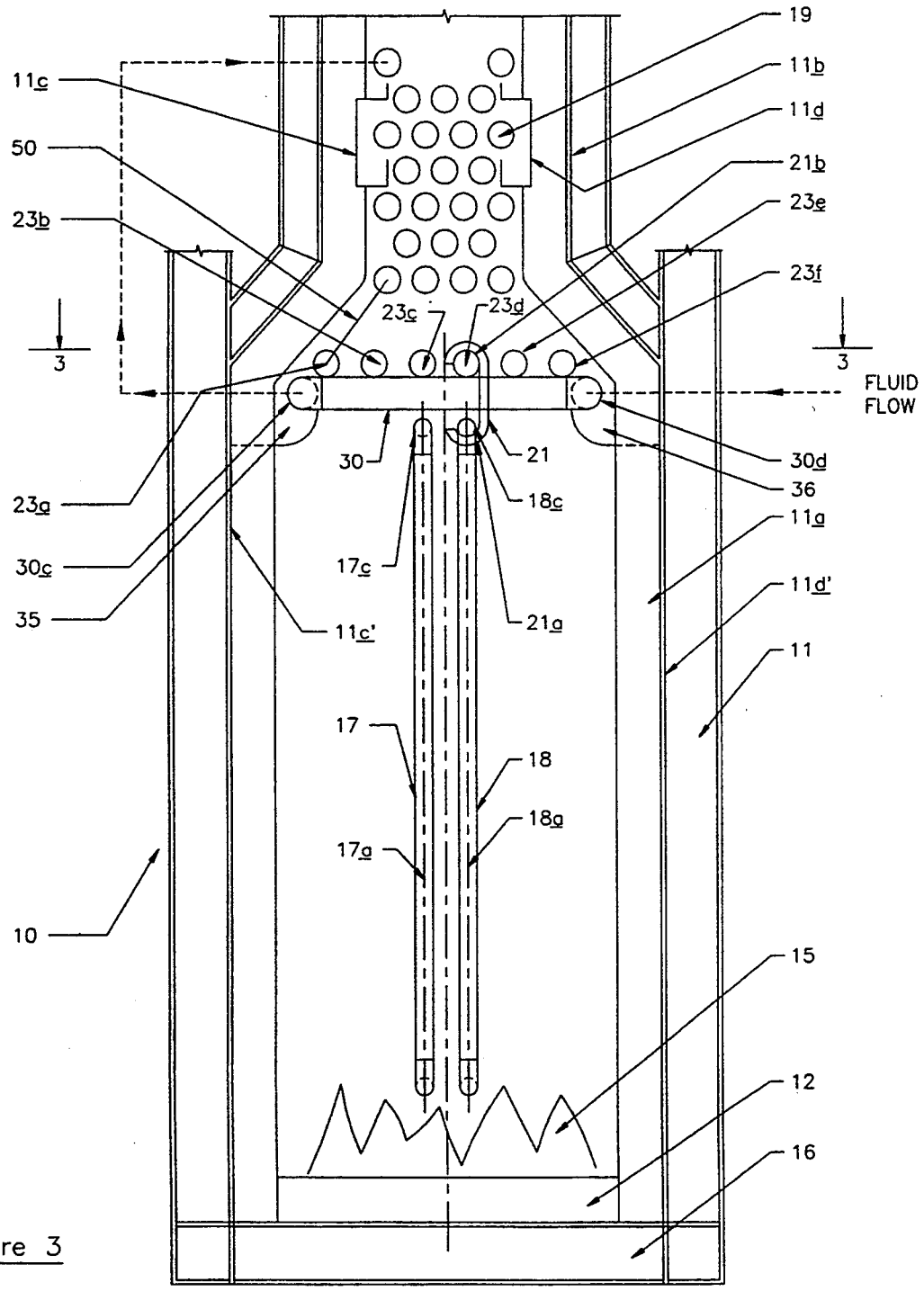
FIG. 3 is a top plan view taken on lines 3—3 of FIG. 2.

In FIGS. 2 and 3, a furnace 10 is shown, and may comprise a reactor (cracking furnace) or oil heater, as usable in a refinery. Upright housing 11 includes a lower section 11*a*, associated with hydrocarbon fuel burners and windboxes designated at 12. The latter receive air and hydrocarbon fluid to produce burner flames at 15. The housing 11 is supported at 16.

Figure 1:
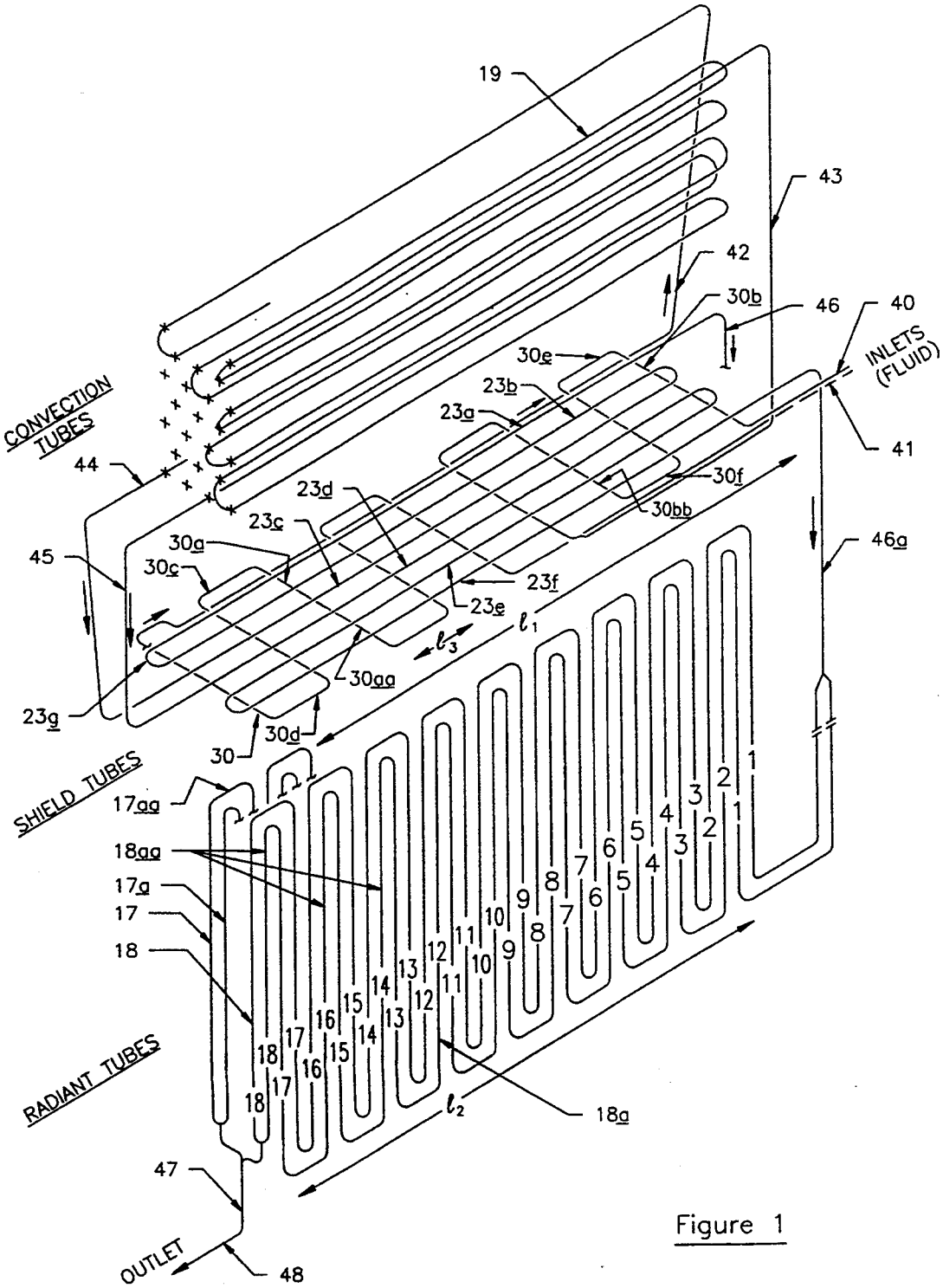
FIG. 1 is a perspective view of a furnace coil or tube combination, in accordance with the invention.

Located within the radiant section 11*a* of the housing are two vertical rows 17 and 18 of heat transfer tubes 17*a* and 18*a*, in the path of the flames and combustion gases. Tubes 17*a* extend up and down in serpentine relation, as do tubes 18*a*. Process fluids are fed to the tubes, as discussed below, whereby the fluids flow endwise through the tubes connected in series in each row to receive heat transfer by radiation from hot gases flowing upwardly through the housing, via the lower radiant section and then via the upper, narrowed "convection" housing extent 11*b*. The latter contain additional heat transfer tubing 19 typically extending horizontally, as seen in FIGS. 1–3. The tubes 19 are spaced or staggered to be contacted by the hot gases entering and flow upwardly in the housing upper extent 11*b*. Hot gases flow upwardly to a stack, not shown, and then leave the furnace. Tubes 19 are suitably supported by the walls 11*c* and 11*d*.

In accordance with the invention, the vertical tube rows 17 and 18 are suspended via upper looping ends 17*c* and 18*c* of the tubes, as seen in FIG. 3. Tube rows 17 and 18 may be considered as one form of first tubular means.

Second tubular means is provided to extend generally horizontally above the rows 17 and 18, for suspending the latter, as via hangers 21, which may be C-shaped. The hangers have lower arm portions 21*a* fitting under certain looping ends 17*c* and 18*c*, and upper arm portions 21*b* fitting over the elongated tubes 23*c* and 23*d* of the second tubular means 23. The latter may include several such tubes 23*a*–23*f*, connected end-to-end in series, via tube turns 23*g*, as shown. The length dimensions $1_1$ of the tubes 23*a*–23*f* are equal to or about equal to, the horizontal length dimension $1_2$ of the rows 17 and 18.

The second tubular means is in turn supported at spacings $1_3$ along the tube lengths by grid structure 30, which extends generally horizontally as shown. Structure 30 preferably comprises third tubular means, such as two tubes 30*a* and 30*b*, each extending in serpentine relation in the length direction of tubes 23*a*–23*f*. The transverse elements 30*aa* of serpentine tube 30*a*, and the transverse elements 30*bb* of tube 30*b*, centrally support the two tubes 23*c* and 23*d*, which suspend the radiant tube rows 17 and 18. See FIG. 3 showing this relationship.

FIG. 1 shows that the total number of transverse elements 30*aa* and 30*bb* may equal or approximately equals the number of up-down tube pairs 17*aa* in row 17, as well as the number of tube pairs 18*aa* in row 18, for good load distribution.

The elements 30*c* and 30*d* of tube 30*a*, and the elements 30*e* and 30*f* of tube 30*b*, which extend in the longitudinal direction of the rows 17 and 18, are supported on ledges 35 and 36, carried by furnace lower walls 11*c*' and 11*d*', which are spaced apart to greater extent than upper walls 11*c* and 11*d*.

It will be understood that process fluid (for example hydrocarbon plus dilution steam or other fluid) flowing in the first, second and third tubular means absorbs heat from such tubing, cooling same to temperatures substantially lower than would exist in the absence of such flow. This extends the service lives of the tubes saving the cost of replacement at more frequent intervals.

FIG. 1 shows flow process fluid flow from inlet 40 to grid tubing 30*b*, and from inlet 41 to grid tubing 30*a*; flow of pre-heated fluid at 42 and 43 from the grid tubings to the convective tubing 19; flow from tubing 19 at 44 and 45 to the intermediate support tubes 23*c* and 23*d*, and from the latter to tubes 23*b* and 23*a*, and to tubes 23*e* and 23*f*; and flow at 46 from tube 23*a* to the row 17 of vertical radiant tubes, and 46*a* from tube 23*f* to the row 18 of vertical radiant tubes. Process fluid then flows from rows 17 and 18 to combine at 47 for flow at 48 to the remainder of the process.

Accordingly, four groups of series-connected tubings are provided at four different levels. The tubings 23 and 30 extend proximate the level of narrowing of the furnace, at 50 between the radiant and convection sections.

FIGS. 4, 5 and 6*a*–6*e* show another similar installation incorporating the invention. A single row 117 of vertical tubes (corresponding to 17), as in a radiant coil, is centrally suspended in the radiant section 111*a* of the furnace 111. A single, horizontal, hanger tube 123 centrally suspends the vertical tubes; as via upper bends 117*a* and hangers 140; and tube 123 may be connected in series with convective tubing or coil 119 in section 111*b* and with the vertical tubing row, as is seen in FIG. 5. See also inlet 141 to tubing 119, and outlet 142 from tubing 117. Crosswise extending sections 130*a* of grid tubing support the single tube 123. The furnace housing is shown at 143. Process fluid passing through serpentine grid tube 130 may flow independently of fluid in coils 119 and 117. FIGS. 6*a* to 6*e* show the construction, at different levels, in plan. Ledges 135 and 136 support the serpentine grid tube. Tubing 117 bottom return bends are shown at 117*b*.

If desired, the grid structure 30 and second tube means 23 may be located in the second convective section 11*b*, the hanger elements 21 then being more vertically elongated.

In FIGS. 7*a* and 7*b*, the arrangement is generally like that of FIGS. 1 and 2 except that the second tubular means 200 is shown directly supporting the first tubular means 201. The means 201 has generally vertically elongated extents 202 which are generally horizontally spaced apart and extend in parallel relation. They correspond to tubes 17 and 18 in FIG. 1. Note that such tubes are staggered, as between the two parallel vertical planes 203 and 204 shown in FIG. 7*b*. All of 201 and 202 are metallic, as for example steel.

The vertical extents 202 have upper end extents indicated at 202*a*, which have inverted U-shape, and extend over and directly engage the second tubular means 200; the latter is shown as a process-flow passing horizontally extending tube 206, typically supported by a grid 30 as seen in FIGS. 1 and 2. Thus, the undersides of 202*a* rest on and conduct heat from the upper side of 206. All load-bearing elements are cooled by process fluid flowing therein, and need for hangers, as at 21, is eliminated, increasing the life of the tube hanging system.

Note further that each vertically elongated extent 202 is connected at its upper end via an upper end extent 202*a* to the upper end extent of the next in sequence (and staggered) vertically elongated extent 202. Note that the staggered sequence of pipes 202 in direction 210, is A, B, C, D, E, F, and G, wherein B, D, and F are staggered relative to A, C, E, and G. Also, B is connected at its upper end to A, and at its lower end of E, via lower end extent 202*b*; and D is connected at its upper end to C, and at its lower end to the lower end of G. Accordingly, each pipe 202 is inserted at its lower end to the lower end of another pipe, which is beyond the next in staggered sequence pipe.

Staggering of piping 202 provides spacing between sequential pipes for maximum heat transfer into the pipes and process liquid therein.

I claim:

1. In a furnace, the combination comprising a) a lower radiant section and an upper convection section, said lower section having associated fuel burners, b) generally vertically extending first tubular means in said first section, c) second tubular means extending generally horizontally relative to said first section and suspending said first tubular means, d) and grid structure extending generally horizontally and supporting said second tubular means, e) whereby hot combustion gases produced by said burners flow upwardly in said first section and past said first and second tubular means and said grid structure to said upper convection section, f) said second tubular means directly supporting said first tubular means.

2. The combination of claim 1 wherein said second tubular means and grid structure are located proximate the uppermost extent of said first section.

3. In a furnace, the combination comprising a) a lower radiant section and an upper convection section, said lower section having associated fuel burners, b) generally vertically extending first tubular means in said first section, c) second tubular means extending generally horizontally relative to said first section and suspending said first tubular means, d) and grid structure extending generally horizontally and supporting said second tubular means, e) whereby hot combustion gases produced by said burners flow upwardly in said first section and past said first and second tubular means and said grid structure to said upper convection section, f) and wherein said grid structure comprises third tubular means.

4. The combination of claim 3 wherein said third tubular means has open work configuration.

5. The combination of claim 4 wherein said third tubular means includes tubing having serpentine configuration.

6. In a furnace, the combination comprising a) a lower radiant section and an upper convection section, said lower section having associated fuel burners, b) generally vertically extending first tubular means in said first section, c) second tubular means extending generally horizontally relative to said first section and suspending said first tubular means, d) and grid structure extending generally horizontally and supporting said second tubular means, e) whereby hot combustion gases produced by said burners flow upwardly in said first section and past said first and second tubular means and said grid structure to said upper convection section, f) and wherein said first and second tubular means are in fluid-passing communication.

7. The combination of claim 3 wherein said first and third tubular means are in fluid-passing communication.

8. The combination of claim 5 wherein said first, second and third tubular means are in fluid-passing communication.

9. The combination of claim 1 including metallic hangers supported by said second tubular means and supporting said first tubular means at laterally spaced locations.

10. The combination of claim 1 wherein said furnace has upright side walls, and associated ledges supporting said grid structure.

11. The combination of claim 1 wherein said first tubular means is arranged in multiple rows, each with serpentine configuration.

12. The combination of claim 1 wherein said first tubular means is arranged in one row with serpentine configuration.

13. The combination of claim 1 including horizontally extending tubing extending in said convective section, and in fluid flow communication with said first tubular means.

14. The combination of claim 12 including horizontally extending tubing extending in said convective section, and in fluid flow communication with said first tubular means.

15. The combination of claim 3 wherein said second tubular means directly supports said first tubular means.

16. The combination of claim 1 wherein said first tubular means has generally vertically elongated extents which are horizontally spaced apart, and upper end extents which have inverted U-shape and which extend over and contact said second tubular means.

17. The combination of claim 16 wherein said generally vertically elongated extents are staggered, in the direction of elongation of said second tubular means.

18. The combination of claim 17 wherein said generally vertically elongated extents are in staggered sequence and each vertically elongated extent is connected at one end to a next in sequence vertically elongated extent, and at its other end to a vertically elongated extent beyond another next in sequence vertically elongated extent.

19. The combination of claim 18 wherein the staggered sequence is A, B, C, D, E, F, and G, wherein B, D and F are staggered relative to A, C, E, and G, and wherein B is connected at one end to A, and at its other end to E, and D is connected at one end to C, and at its other end to E.

* * * * *